US006823644B1

(12) United States Patent
Peterson

(10) Patent No.: US 6,823,644 B1
(45) Date of Patent: Nov. 30, 2004

(54) SPACER FRAME BAR FOR INSULATED WINDOW

(76) Inventor: Wallace H. Peterson, 5312 - 23 Ave. W., Everett, WA (US) 98203

( * ) Notice: Subject to any disclaimer, the term of this patent is extended or adjusted under 35 U.S.C. 154(b) by 0 days.

(21) Appl. No.: 09/548,518

(22) Filed: Apr. 13, 2000

(51) Int. Cl.[7] ..... E04C 2/54

(52) U.S. Cl. ..... 52/786.13; 52/172; 52/730.4; 52/717.02

(58) Field of Search ..... 52/171.3, 172, 52/788.1, 789.1, 790.1, 786.13, 730.4, 717.02; 428/34, 402, 70, 75, 76, 83, 121, 130, 131, 137; 156/107, 109

(56) References Cited

U.S. PATENT DOCUMENTS

| | | | | |
|---|---|---|---|---|
| 3,114,179 A | * | 12/1963 | Briggs | 52/172 |
| 4,080,482 A | * | 3/1978 | Lacombe | 52/172 |
| 4,222,213 A | * | 9/1980 | Kessler | 52/172 |
| 4,479,988 A | * | 10/1984 | Dawson | 52/172 |
| 4,576,841 A | | 3/1986 | Lingemann | 428/34 |
| 5,209,034 A | * | 5/1993 | Box et al. | 52/171 |
| 5,424,111 A | * | 6/1995 | Farbstein | 428/137 |
| 5,439,716 A | | 8/1995 | Larsen | 428/34 |
| 5,461,840 A | * | 10/1995 | Taylor | 52/786.13 |
| 5,568,714 A | * | 10/1996 | Peterson | 52/786.13 |
| 5,581,971 A | | 12/1996 | Peterson | 52/786.13 |
| 5,617,699 A | * | 4/1997 | Thompson, Jr. | 52/786.13 |
| 5,630,306 A | * | 5/1997 | Wylie | 52/786.13 |
| 5,679,419 A | * | 10/1997 | Larsen | 52/786.13 |
| 5,851,627 A | * | 12/1998 | Farbstein | 428/137 |
| 6,351,923 B1 | * | 3/2002 | Peterson | 52/786.13 |

FOREIGN PATENT DOCUMENTS

| | | | | |
|---|---|---|---|---|
| DE | 3521848 | * | 6/1985 | E04C/2/54 |

* cited by examiner

*Primary Examiner*—Carl D. Friedman
*Assistant Examiner*—Chi Q. Nguyen
(74) *Attorney, Agent, or Firm*—Todd N. Hathaway

(57) ABSTRACT

Spacer frame tubing for being mounted between first and second panes in an insulated window assembly, the tubing being configured to flex inwardly and outwardly in response to inwardly and outwardly directed pressures exerted by the glass panes so as to minimize the tendency of the panes to pivot against the sidewalls of the tubing. The reduction in pivoting action reduces the tendency of the edges of the panes to alternately pull away from and press against the sealing strip around the perimeter of the window assembly as the panes bow in response to changes in atmospheric pressure, thereby reducing the tendency of the edges of the panes to separate from or fracture against the sealing strip. The tubing has first and second side walls for engaging the inside surfaces of the glass panes, and a transverse wall interconnecting the sidewall portions. The transverse wall portion is made up of first and second web portions that are joined by a seam structure, the seam structure being formed by a series of overlapping and underlapping tab portions which engage one another in sliding interfit. The sliding interfit permits the web portions to slide towards and away from one another while still keeping the seam structure intact. The tubing may be constructed of roll-formed aluminum alloy sheet material, and a particulate desiccant material may be enclosed within the hollow interior of the tubing.

35 Claims, 9 Drawing Sheets

SPACER FRAME BAR FOR INSULATED WINDOW

BACKGROUND OF THE INVENTION a. Field of the Invention

The present invention relates generally to insulated windows, and, more particularly, to spacer frame tubing for spacing apart inner and outer panes of an insulated window, the tubing being constructed to accommodate inward and outward movement of the panes in response to changes in atmospheric pressure.

b. Related Art

It is well known in the art to provide insulated windows having more than one pane of glass, the panes being separated by an air space. Typically, the panes are maintained in spaced apart relationship by a frame that is interposed between their edges. The interior space between the panes, which is typically filled with air or other gas, thus serves as an insulator to reduce heat flow through the window. In the prior art it is known to manufacture the frame from a plurality of individual tubes joined at their ends to form a continuous frame, or of a single tube which is bent to form the frame. The tubes are generally made of aluminum alloy, or of molded plastic or other material having sufficient rigidity to maintain the space between the panes; aluminum alloy has the advantages of strength, stability and longevity for this use.

The tubing typically has a somewhat rectangular form so as to provide inner and outer side walls for supporting the glass panes, and the hollow interior of the tubing often contains a supply of desiccant material which removes moisture from the interpane air space. Examples of spacer tubes of this general configuration include those shown in U.S. Pat. Nos. 4,222,213 (Kessler), 4,576,841 (Limgemann), 5,439,716 (Larsen), and 5,581,971 (Peterson); many other examples of spacer frame tubing will occur to those skilled in the art.

Although very successful in most respects, it has been discovered that the configuration of conventional frame tubing may create a long term "weak spot" in many insulated window assemblies, especially those having relatively large, continuous panes of glass, such as are commonly used in office buildings and similar structures.

To illustrate this problem, FIG. 1 shows an example of conventional spacer frame tubing 10 installed between first and second glass panes 12, 14 so as to define the interpane air space 16. As was described above, the spacer tubing has a generally rectangular cross-section with first and second side walls 20, 22 for supporting the panes and a hollow interior 24 which is filled with granular desiccant material 26. In the version which is shown in FIGS. 1–3, the side walls are formed with raised ribs for minimizing the contact area with the glass panes, so as to minimize thermal transfer through the aluminum alloy material of the spacer. A strip of sealant material 28 is installed outside the spacer tubing, i.e., between the tube and the edges of the panes, so as to form an air tight seal which excludes the surrounding atmosphere and moisture from the interpane space 16. The sealant strip is normally formed of a polymeric material which has a degree of resilience and surface adhesion when new, but which tends to lose these qualities with age.

FIG. 1 shows the assembly in its initial configuration, with panes 12, 14 extending parallel to one another and resting more or less flat against the side walls of the spacer tubing and the surfaces of the sealant strip. As soon as the window is installed, however, the panes begin to undergo virtually continuous relative movement due to changes in atmospheric pressure. As was noted above, the window is hermetically sealed by the strip 28, so that the pressure in the interpane space does not equalize with that of the surrounding air. As a result, an increase in pressure, as is shown in FIG. 2, causes the two panes to bow inwardly, in the directions indicated by arrows 30*a*, 30*b* (this movement being somewhat exaggerated in the figures for purposes of illustration), with the greatest amount of inward deflection taking place towards the middle of the unsupported window and away from the spacer tubing 10. As this happens, the inner surfaces 32, 34 of the glass panes react and pivot against the side walls 20, 22 of the spacer tubing, with the result that the edge portions 36, 38 of the panes which extend beyond the spacer tubing move apart in corresponding, outward directions, as indicated by arrows 40*a*, 40*b*. This motion draws the inner surfaces 32, 34 of the panes outwardly, away from the surfaces 42, 44 of the sealant strip, with the result that the sealant eventually separates from the glass around the outer edges of the panes and thereby creates gaps and breaks in the seal, as indicated at arrows 46 and 48 in FIG. 2.

Conversely, a decrease in atmospheric pressure, as is illustrated in FIG. 3, causes the panes 12, 14 to bow outwardly towards their centers, as indicated by arrows 50*a*, 50*b*. As this happens, the sides 20, 22 of the spacer tubing again act somewhat in the manner of pivot points (due in part to the adhesion of the sealant material), and the edges 36, 38 of the panes press inwardly against the sealant strip 28 in the direction indicated by arrows 52*a*, 52*b*. This action tends to draw the inside surfaces of the panes away from the surfaces 42, 44 of the sealant along the sides of the spacer tubing, eventually causing the formation of additional gaps or openings, as indicated at 54, 56. Moreover, the sealant strip 28 resists being compressed between the edges of the glass panes, especially if the strip has hardened and lost it resilience, so much so that the edges of the panes can sometimes fracture and chip so as to leave little or no contact area between the pane and the sealant in the damaged area.

While the actual amounts of movement are comparatively small in absolute terms, they are significant (for example, the "bellows effect" generated by the flexing of the panes is sufficient to be employed to circulate the interpane air into and out of the desiccant material in some types of spacer tubing) and the resulting loads on the components can be quite great. In particular, with a very large window the distance from the unsupported centers of the panes to the spacer tubing around the perimeter of the window creates a very large lever arm as compared with the distance from the tubing to the outer edges of the panes, so that a small amount of movement at the centers of the panes results in comparatively large forces being exerted at the edges of the assembly.

The atmospheric pressure changes which generate these forces occur almost continuously, with pressures often fluctuating up and down several times in a single day, so that a window assembly may experience these forces/motions over several thousand cycles during its lifetime. As a result, the repeated pulling away from the sealant and/or chipping of the panes eventually leads to one or more breaches being formed in the hermetic seal around the edge of the window assembly. This allows moisture to enter the interpane space, so that the window quickly becomes fogged and must be replaced.

Many modern structures, such as large office towers are fitted with a huge number of insulated window assemblies.

The cost of having to replace even a few of these window assemblies can be extraordinarily high, and so any improvement which extends the service life of the assemblies can easily translate to large economic savings.

Accordingly, there exists a need for a spacer tubing having a construction which reduces or eliminates the tendency of the outer edges of the glass panes in an insulated window assembly to pull away from and press against the sealant strip at the edge of the assembly as the panes flex inwardly and outwardly in response to changes in atmospheric pressure. Furthermore there exists a need for such a spacer tubing which has a hollow interior for containing a supply of desiccant material therein, and which permits a degree of fluid communication between the interior of the tubing and the interpane space so as to allow the desiccant material to withdraw moisture therefrom. Still further, there exists a need for such a spacer tubing which is economical to manufacture, and which is sufficiently strong and durable to enjoy a long service life. Still further, there exists a need for such a spacer tubing which is compatible with existing window assembly techniques, and which does not require special equipment or techniques in order to fabricate a spacer frame therefrom.

SUMMARY OF THE INVENTION

The present invention has solved the problems cited above. Broadly, this is a spacer frame tubing for being mounted between first and second glass panes in an insulated window assembly, the tubing comprising first and second side wall portions for engaging inner surfaces of the glass panes and a transverse wall portion interconnecting the side wall portions so as to support the side wall portions in spaced-apart relationship, the transverse wall portion being configured to permit the side wall portions to move alternately towards and away from one another in response to inward and outward forces inserted by the glass panes so as to minimize development of a pivoting action between the inside surfaces of the panes and the side wall portions of the tubing.

In a preferred embodiment, the transverse wall portion of the tubing may comprise at least first and second web portions which extend from the side wall portions and are joined by a seam structure, the seam structure being configured to permit the web portions to move alternately towards and away from one another in response to the inward and outward forces which are exerted by the glass panes in the window assembly. The seam structure may comprise a plurality of tab portions formed on edges of the first and second web portions, the tab portions on the first web portion forming a sliding interfit with the tab portions on the second web portion so as to permit the web portions to move alternately towards and away from one another without separating.

The tab portions on the edge of the first web portion may alternately overlap and underlap the tab portions on the edge of the second web portion in a sliding engagement therewith. The overlapping and underlapping tab portions may form generally planar engagement surfaces which extend generally parallel to the web portions, and the first and second web portions may extend in generally co-planar relationship to form a flat inner surface on the tubing.

The tab portions on each edge of the web portions may comprise alternating upper and lower tab portions, the upper tab portions extending in generally co-planar relationship with the web portions and the lower tab portions bending downwardly from base portions which are joined to the web portion. Each of the tab portions may comprise a substantially rectangular outer end, and the base portions of the lower tab portions may be positioned at spaced distances from the juxtapositioned outer ends of the upper tab portions so as to form gaps for permitting the ends of the upper tab portions to move towards the bases of the lower tab portions as the web portions move towards one another. The rectangular outer ends of the upper and lower tab portions may also comprise first and second edge faces for engaging the edge faces on adjoining tab portions in sliding interfit therewith.

The spacer frame tubing may further comprise a second transverse wall portion, so that the sidewall portions and transverse wall portions define a hollow interior of the tubing. The tubing may have generally rectangular cross section; and there may be at least one projecting rib formed on each side wall portion for limiting engagement with the inner surfaces of the glass panes to line-contact therewith; the projecting ribs may be formed proximate the transverse wall portion having the seam structure formed therein. A particulate desiccant material may be disposed within the hollow interior of the tubing.

The present invention also provides an insulated window assembly, comprising first and second glass panes having inner surfaces and spacer frame tubing mounted between the first and second glass panes, the tubing comprising first and second side wall portions for engaging inner surfaces of the glass panes and a transverse wall portion interconnecting the side wall portions so as to support the side wall portions in spaced apart relationship, the transverse wall portion being configured to permit the side wall portions to move alternately towards and away from one another in response to inward and outward forces exerted by the glass panes so as to minimize development of a pivoting action between the inner surfaces of the panes and the side wall portions of the tubing.

The spacer frame tubing may be mounted between outer edges of the glass panes proximate a perimeter of the window assembly, with said inward forces exerted against the sidewall portions of the tubing being caused by an inward bowing of the glass panes in response to an increase in atmospheric pressure, and the outward forces exerted against the sidewall portions of the tubing being caused by an outward bowing of the glass panes in response to a decrease in atmospheric pressure. The assembly may further comprise a sealant strip which is mounted between the outer edges of the glass panes outside of the spacer frame tubing.

These and other features and advantages of the present invention will be apparent from the reading of the following detailed description with reference to the associated figures.

DETAILED DESCRIPTION a. Overview

The present invention provides a form of construction for window spacer frame tubing, in which a transverse wall of the tubing is provided with a seam structure which undergoes lateral compression and expansion in response to inwardly and outwardly directed pressure exerted by the edges of the glass panes. This lateral movement allows the effective width of the transverse wall to decrease and increase in response to the pressures, thereby reducing or eliminating the tendency of the glass panes to develop a pivoting action against the sidewalls of the tubing. As a result, forces which would otherwise cause the panes to pull away from the spacer tubing and the sealant strip around the perimeter of the window assembly are greatly reduced or eliminated. This in turn helps to maintain the integrity of the hermetic seal at the edge of the window assembly and greatly extends the service life of the assembly.

As used in this description and the appended claims, the term "tubing" is meant to include all tubes, bars and similar structures which serve the purpose of maintaining a spaced distance between the panes in an insulated window assembly, whether or not these have a hollow core or interior as in the preferred embodiment shown herein. Moreover, it will be understood that, while the advantages of the present invention are believed to be best achieved with the compressible seam disposed towards the interpane air space, there may be other embodiments in which the seam faces in the opposite direction, i.e., towards the outer edge of the assembly. Still further, it will be understood that, while in most embodiments a seam strip will be installed between the edges of the glass panes outside of the spacer tubing as is shown herein, there may be some embodiments in which there is no sealant strip, or the sealing means may be formed as an integral part of the spacer tubing itself.

b. Structure

Figure 1:
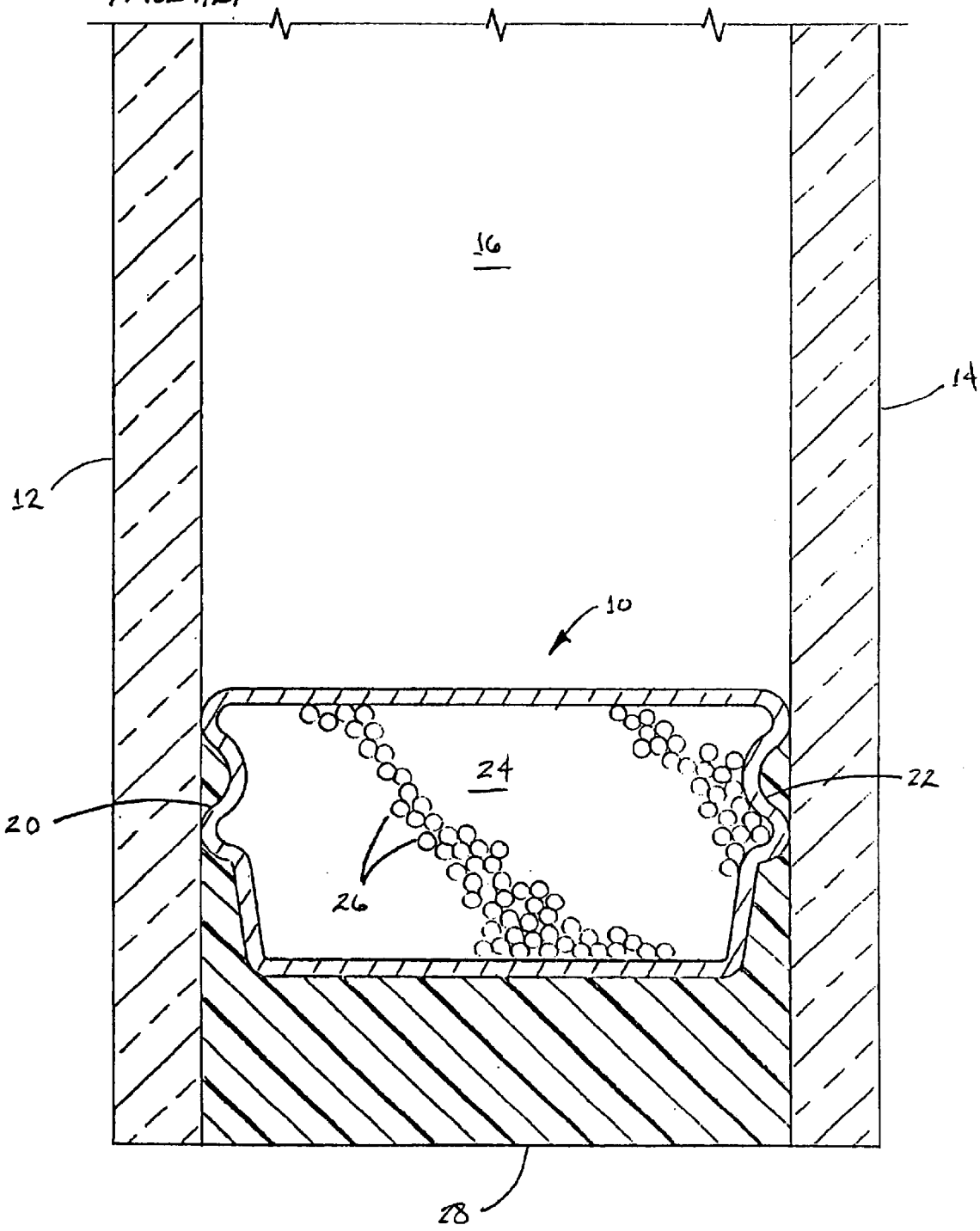
FIG. 1 PRIOR ART
FIG. 1 is an enlarged, cross-sectional view of spacer tubing in accordance with the prior art, showing this mounted between first and second glass panes at the edge of an insulated window assembly.
Figure 2:
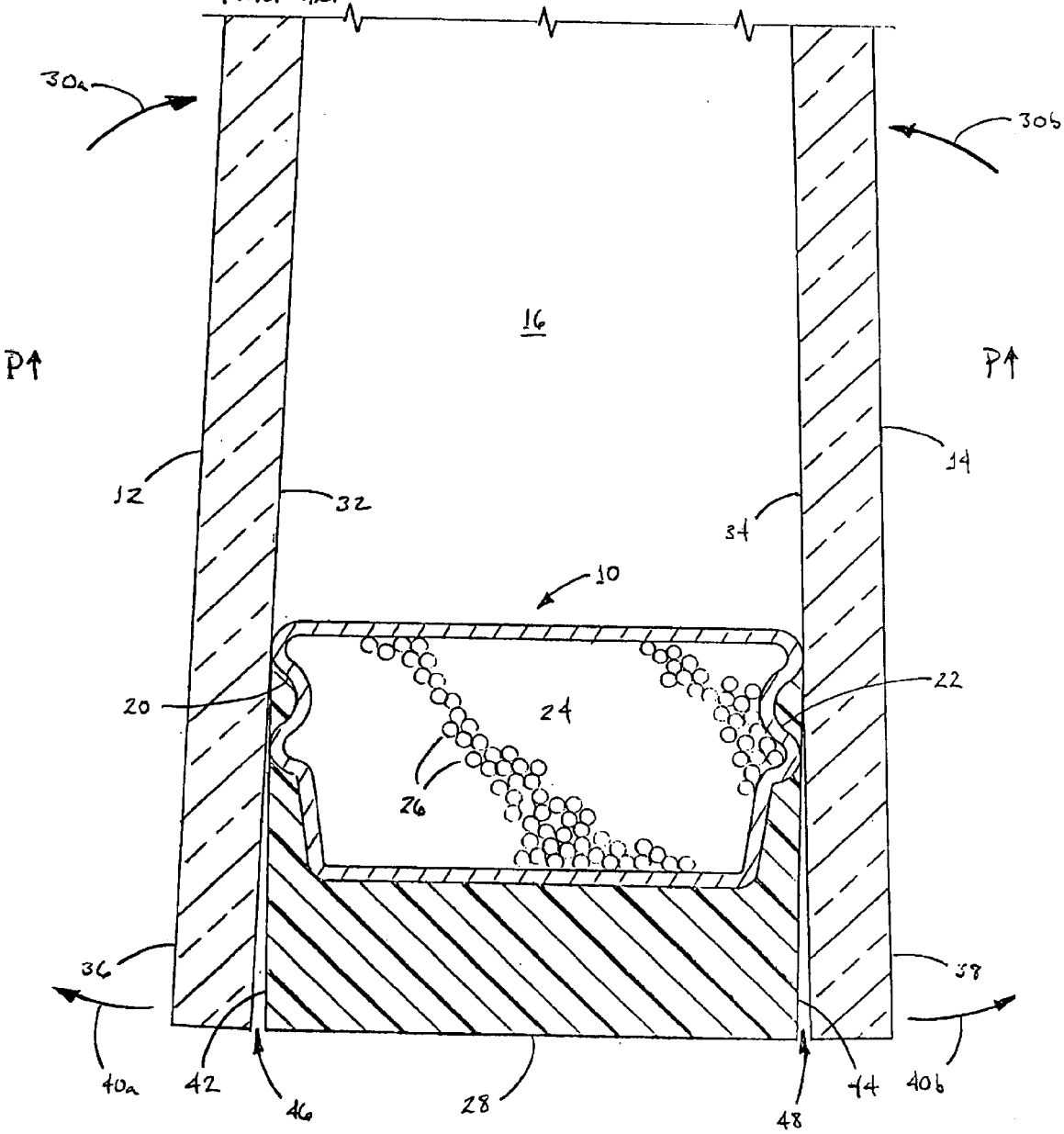
FIG. 2 PRIOR ART
FIG. 2 is a cross-sectional view, similar to FIG. 1, showing the manner in which inward flexing of the glass panes due to an increase in atmospheric pressure causes the outer edges thereof to react against the spacer tubing so as to pull away from the sealant strip at the edge of the assembly.
Figure 3:
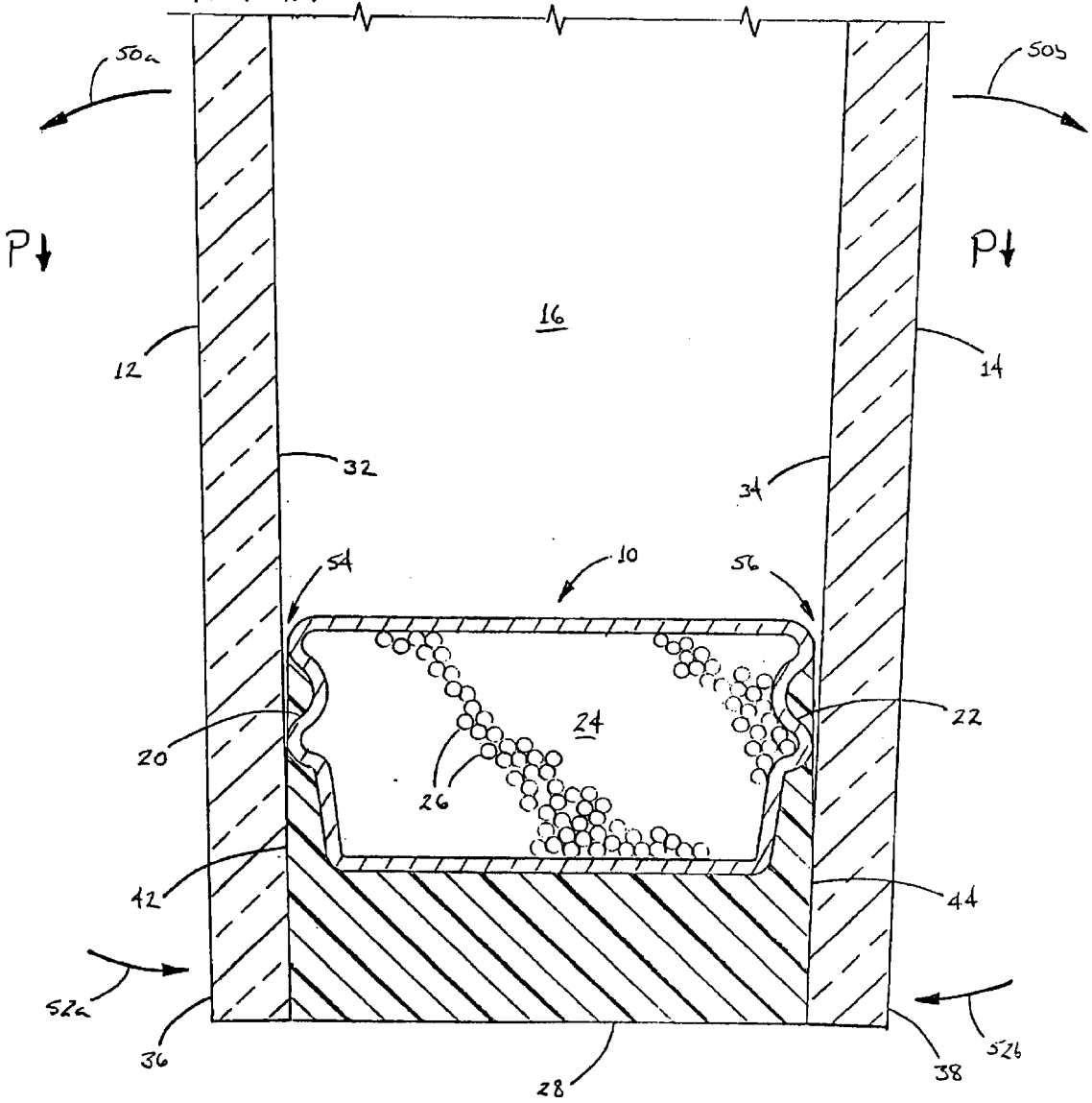
FIG. 3 PRIOR ART
FIG. 3 is a cross-sectional view, similar to FIGS. 1–2, showing the manner in which outward bowing of the glass panes due to a decrease in atmospheric pressure causes the outer edges thereof to react against the spacer tubing so as to press inwardly against the sealant strip.
Figure 4:
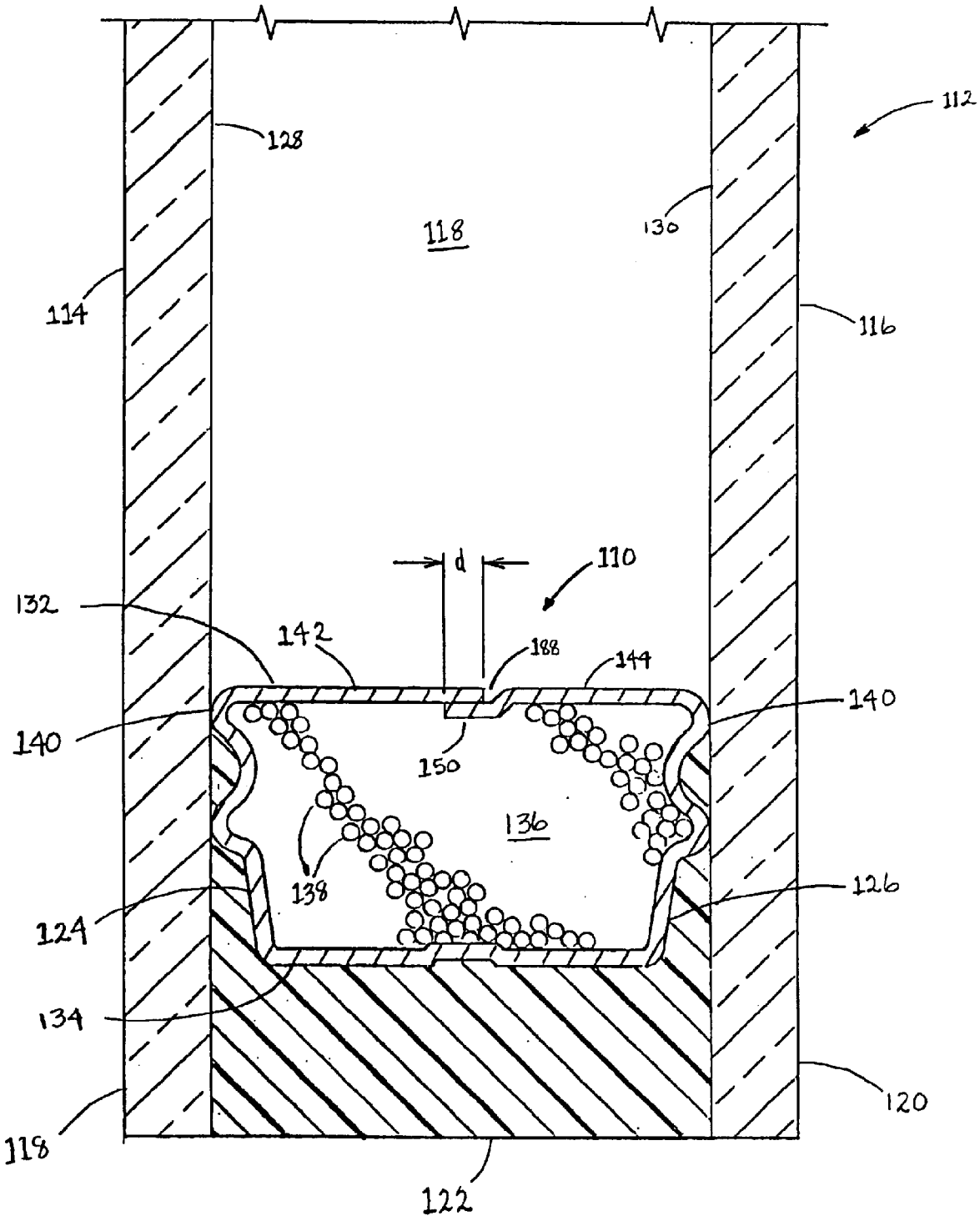
FIG. 4 is an enlarged, cross-sectional view, similar to FIG. 1, showing spacer tubing in accordance with the present invention mounted between parallel glass panes at the edge of an insulated window assembly.

FIG. 4 shows a section of spacer frame tubing 110 in accordance with the present invention, mounted at the edge of a window assembly 112 between first and second glass panes 114, 116. As with the window assembly which is shown in FIGS. 1–3, the glass panes define an interpane air space 117 which reduces thermal transfer through the assembly. Also similar to the conventional assembly described above, the outer edge portions 118, 120 of the panes extend beyond the spacer frame tubing 110, with the area between the protruding edges of the panes being filled by a sealant strip 122. The sealant strip may be formed of any suitable sealant material, such as that which has been described above, and may be applied in a solid, liquid or semi-liquid form.

Spacer tubing 110 has a generally rectangular cross-section, with first and second side walls 124, 126 that engage and support the inner surfaces 128, 130 of the glass panes, and upper and lower transverse walls 132, 134 that in turn support the sidewalls 124, 126 in spaced-apart relationship. The hollow interior 136 of the tubing is filled with a particulate desiccant material 138, in a manner similar to that described above.

As can be seen with further reference to FIG. 4, the side walls 124, 126 are suitably provided with raised, longitudinal ribs 140, 142 so as to minimize the contact area with the surfaces of the glass panes, and thereby reduce transmission of thermal energy through the tubing. In the preferred embodiment which is illustrated, the spacer tubing is constructed of roll-formed aluminum alloy, although it will be understood that any other suitable, substantially rigid metallic or non-metallic material may be used for this purpose.

The outer wall 134 of the tubing (i.e., that wall which faces outwardly towards the edge of the window assembly and away from the interpane space) is preferably somewhat narrower than the inner wall, and is formed as a single, continuous web in the embodiment which is illustrated. The inner wall 132 (i.e., that wall which faces inwardly towards the interpane space), however, is formed of two longitudinally-extending web portions 142, 144 which are joined by a central seam structure 150. As will be described in greater detail below, the seam structure is configured so that the edge segments of the two web portions overlap one another by predetermined distance "d", and are free to slide laterally with respect to one another in response to inwardly and outwardly directed pressures which are exerted against the side walls of the tubing.

Figure 5:
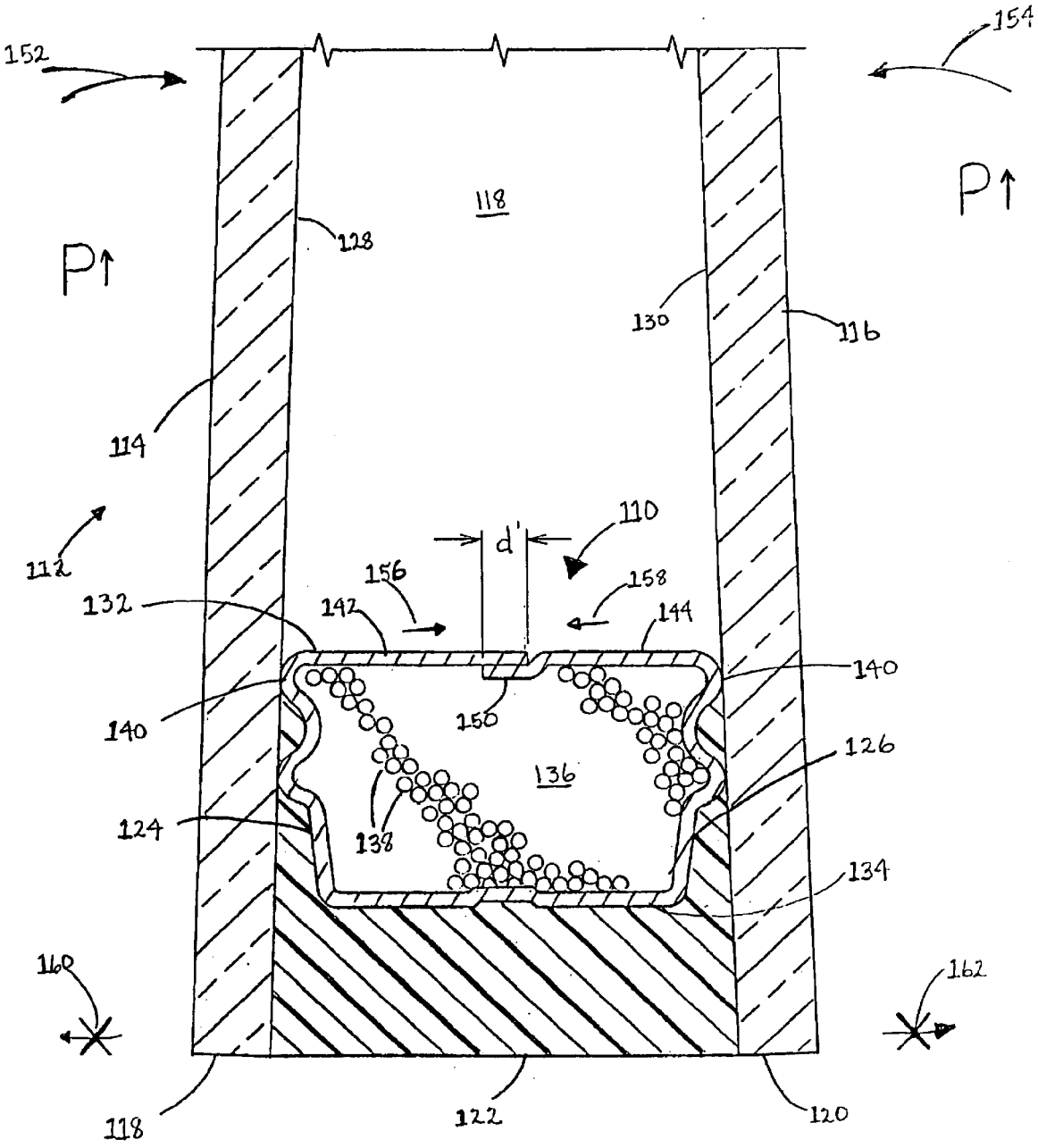
FIG. 5 is a cross-sectional view, similar to FIG. 2, showing the manner in which the compressible seam in the upper wall of the tubing of the present invention enables this to accommodate inward flexing of the glass panes so as to minimize the tendency of the edges thereof to pull away from the sealant strip at the perimeter of the assembly.

Thus, as can be seen in FIG. 5, an increase in atmospheric pressure results in the glass panes 114, 116 bowing inwardly, in much the same manner as described above, in the directions indicated by arrows 152, 154. As this happens, the inwardly directed forces which are applied to the side walls of the tubing cause the two web portions 142, 144 to move towards one another, in the directions indicated by arrows 156, 158. This movement is accommodated by the sliding interfit of the edge tabs which form the seam structure 150, and which increase their overlap as indicated at "d". This resilient inward movement causes a decrease in the width of the inner wall 132, simultaneous with the inward movement of the inner surfaces 128, 130 of the glass panes, thereby minimizing or eliminating the effect of the tubing acting as a pivot point against the panes. As a result, the tendency to develop an outward, spreading movement between the outer edges 118, 120 of the panes is also greatly reduced or eliminated, as indicated by arrows 160, 162 in FIG. 5.

Figure 6:
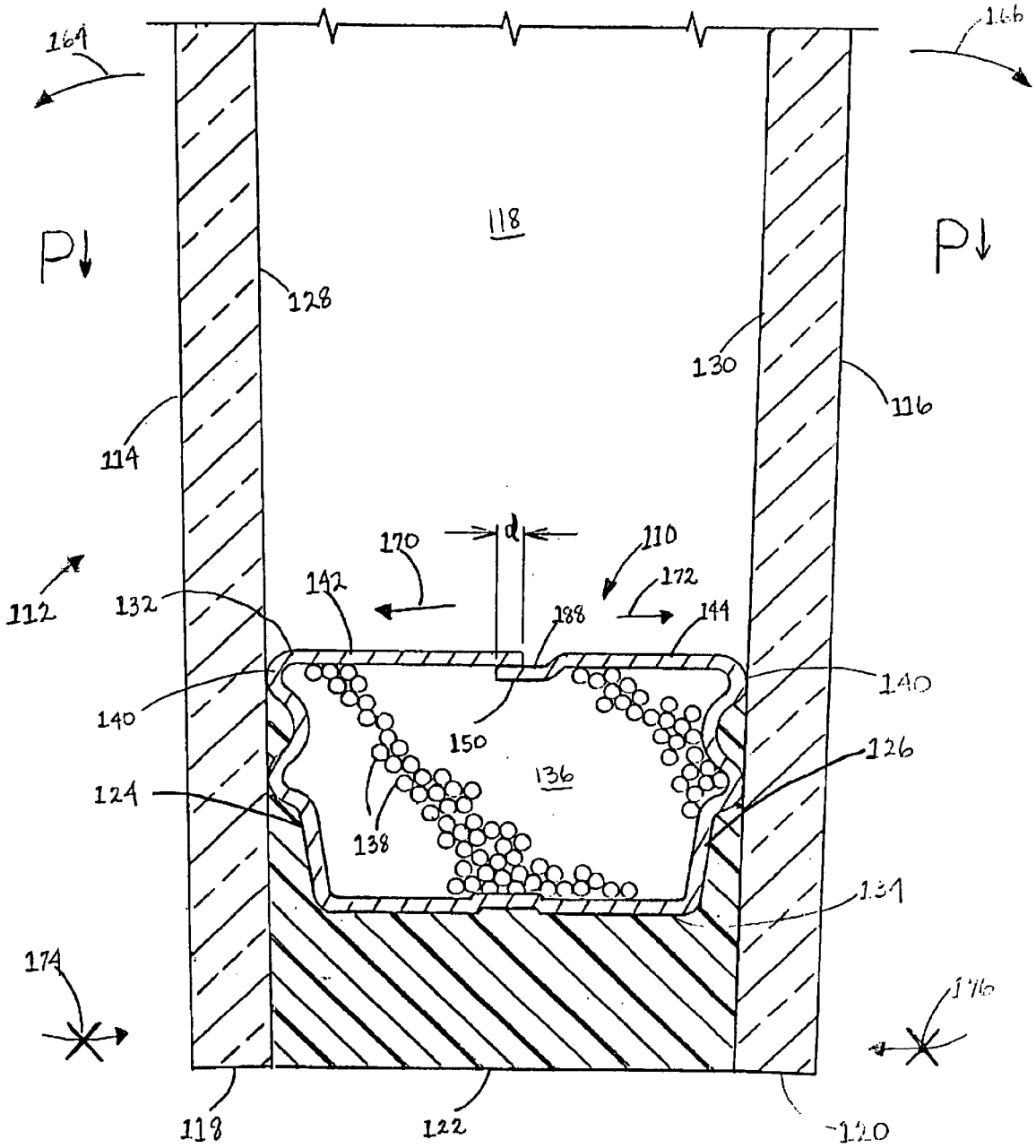
FIG. 6 is a cross-sectional view, similar to FIG. 3, showing the manner in which the compressible seam in the upper wall of the spacer tubing of the present invention enables this to accommodate outward bowing of the glass panes so as to minimize the tendency of the edges thereof to press inwardly against the sealant strip.

Similarly, as is shown in FIG. 6, a decrease in atmospheric pressure causes the central portions of the panes 114, 116 to bow outwardly, as indicated by arrows 164, 162. As this happens, the outwardly directed forces which are applied to the side walls 124, 126 of the tubing (which are bonded to the inner surfaces of the panes by sealant 122) cause the two web portions 142, 144 to be drawn apart, in the directions indicated by arrows 170, 172. This decreases the sliding overlap between the two sets of edge segments, as indicated at "d", and increases the effective width of the inner wall 132 of the tubing, but without causing the sides of the seam to separate (which would allow the desiccant material to escape into the interpane space). Again, this minimizes or eliminates the effect of the tubing providing a pivot point against the inside surfaces of the panes, so that the tendency to develop an inward motion at their outer edges 118, 122 is greatly reduced or eliminated, as is indicated at arrows 174, 176 in FIG. 6.

The ability of the seam 150 to spread and compress in response to inwardly and outwardly directed forces thus greatly reduces the inward and outward motions of the edges of the panes relative to the sealant strip 122. Consequently, the tendency for the edges of the pane to pull away and separate from the sealant strip, or to press against the strip and fracture, is greatly reduced or eliminated. Furthermore, the spreading movement of the seam greatly reducing any tendency for the panes to separate from the inner edges of the spacer tubing.

c. Manufacture

As was noted above, the spacer tubing of the present invention is suitably formed of roll-formed aluminum alloy. FIGS. 7–11 show a preferred manner of forming the tubing using this material.

Figure 7:
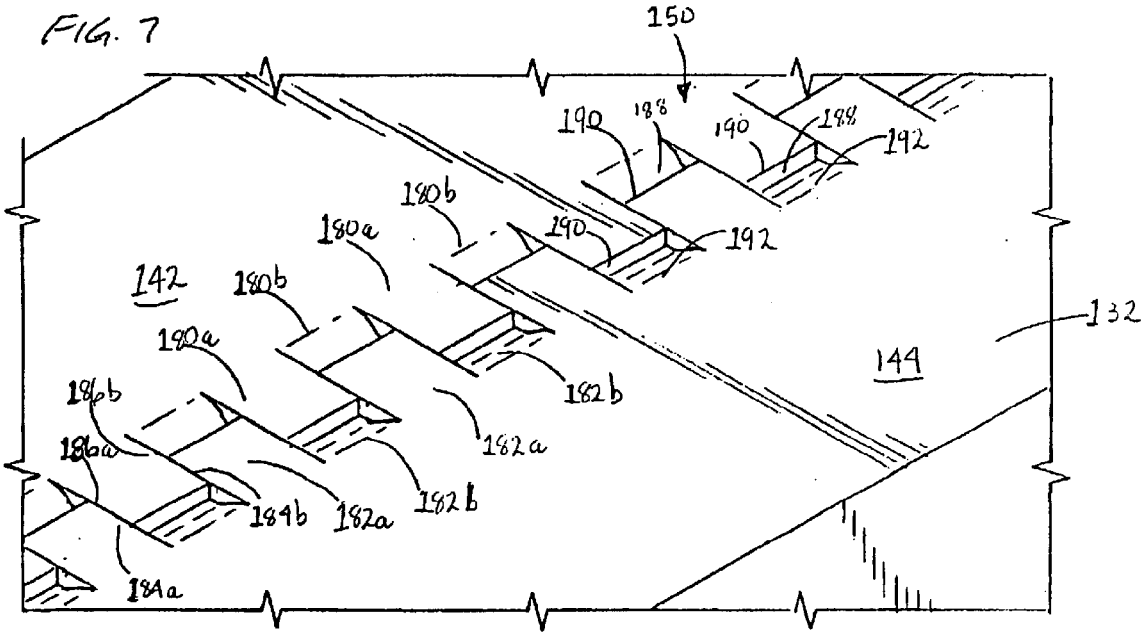
FIG. 7 is an enlarged, perspective view of the upper wall of the spacer tubing of the present invention as shown in FIGS. 4–6, showing the overlapping and interleaved edge segments which form the compressible seam structure therein.

As can be seen in FIG. 7, the overlapping edges of the two web portions 142, 144 which make up the sliding seam structure 150 comprise a series of interleaved tab portions, with a first series of alternating upper and lower tab portions 180*a*, 180*b* being formed along the first web portion 142, and a corresponding series of upper and lower tab portions 182*a*, 182*b* being formed along the opposite web portion 144.

Each tab portion overlaps (either above or below) a corresponding tab portion on the opposite edge of the seam. As can be seen, each of the upper tab portions 180*a*, 182*a* extends in a generally coplanar direction from the web portion on which it is formed, while the lower tab portions 180*b*, 182*b* bend downwardly beneath the upper tab portions so as to establish a sliding engagement against the lower surfaces thereof. The side edges 184*a*, 184*b*, and 186*a*, 186*b* where adjacent tab portions meet also form a sliding interfit which enables the tab portions to move inwardly and outwardly with respect to one another; corresponding side edges, (not visible in FIG. 7) are similarly formed on the lower tab portions 180*b*, 182*b*.

The outer ends of the tab portions have a generally rectangular configuration and are sized so that spaces or gaps 188 are formed between the tips of the upper tab portions and the juxtapositioned bases 192 of the opposite, underlying tab portions, thereby providing room for the ends of the tab portions to move inwardly as the seam is compressed.

The interfitting tab portions thus form a strong, stable seam structure without the need for welding or any other form of fixed connection. A further advantage of the sliding fit between the tab portions is that this allows air to pass through seam structure and into and out of the hollow interior 136 of the tubing, so that the desiccant material can withdraw moisture from the interpane space without requiring separate perforations or openings in the wall of the tubing.

Figure 8:
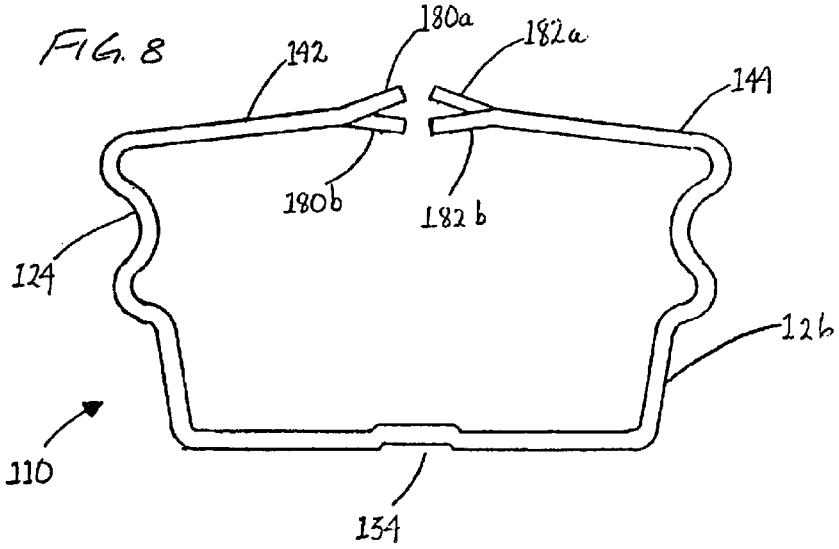
FIG. 8 is an end, cross-sectional view of a section of spacer tubing in accordance with the present invention, showing this in an initial step in the formation thereof, in which the edge tabs on either side of the seam have been displaced alternately upwardly and downwardly in preparation for interleaving with the tabs on the opposite side of the seam.
Figure 9:
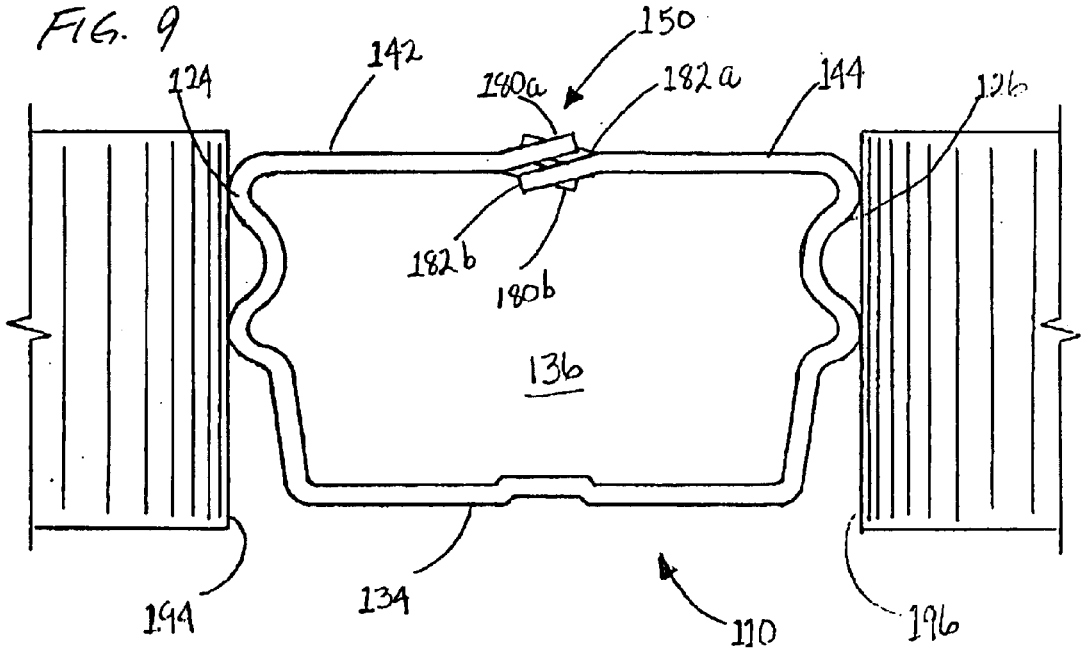
FIG. 9 is an end, cross-sectional view, similar to FIG. 8, showing the section of spacer tubing in a subsequent step in the formation thereof, in which the sidewalls of the tubing are forced together so as to move the tabs on the edge of the seam into interleaved engagement with one another.
Figure 10:
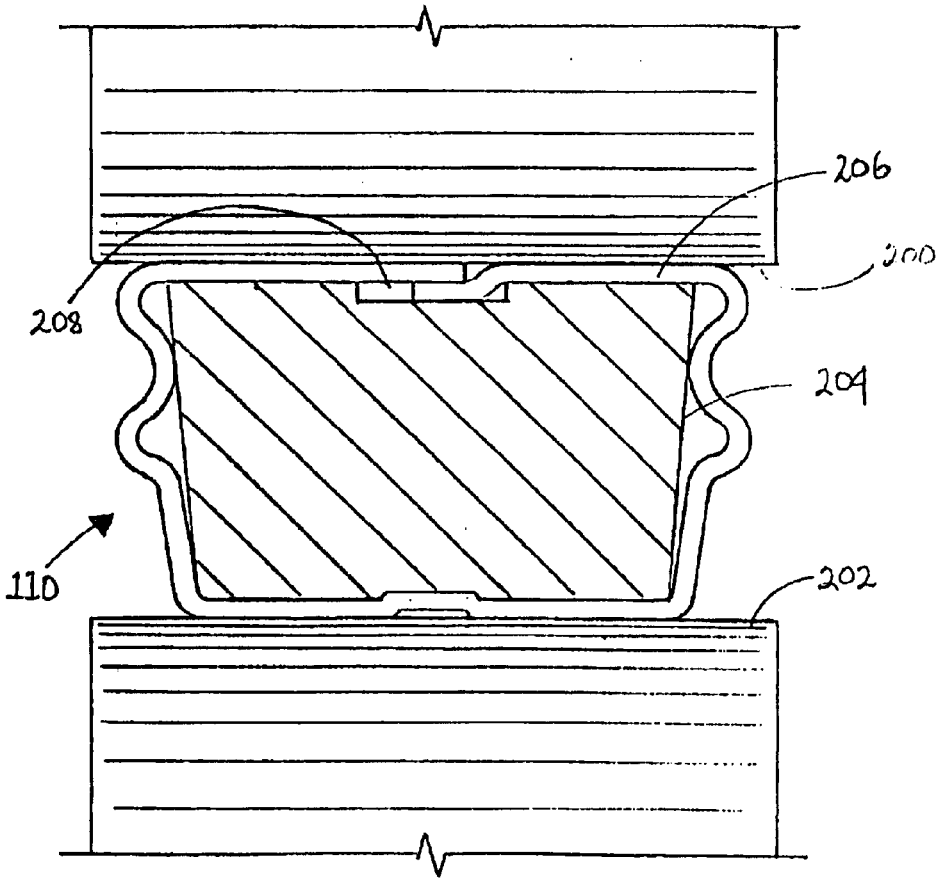
FIG. 10 is a cross-sectional view, similar to FIGS. 8–9, showing the tubing section in a third stage in the formation thereof, in which the interleaved edge segments are pressed between a roller and die so as to form a stable yet compressible seam structure, with a recess of predetermined depth being formed in the upper surface of the die to accommodate the downwardly bent tab portions of the seam structure.
Figure 11:
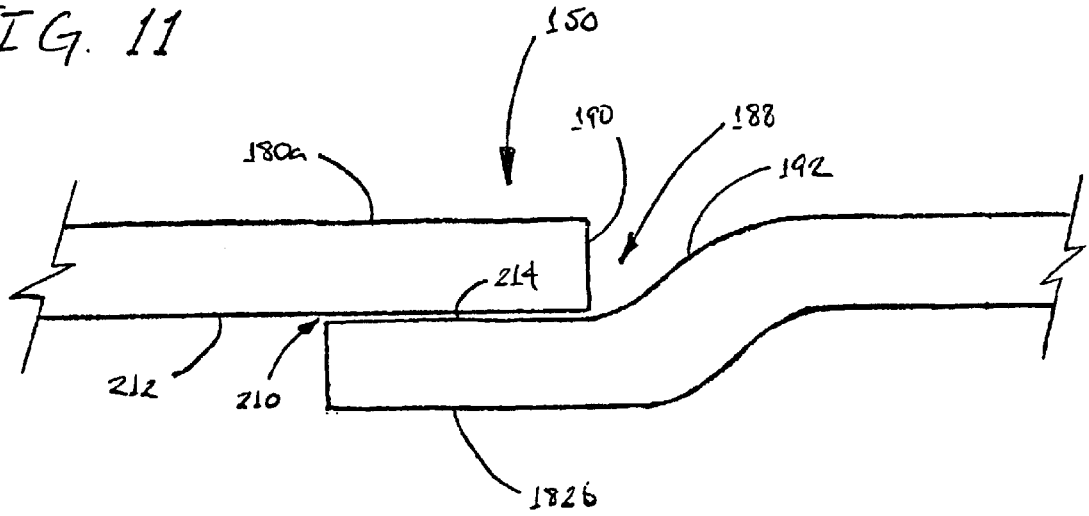
FIG. 11 is an enlarged, cross-sectional view of the seam formed by the steps shown in FIGS. 8–10, showing the vertical clearance which is maintained between the overlapping tab portions so as to permit sliding movement to develop between the tab portion in response to inward and outward pressures exerted against the side walls of the tubing.

FIGS. 8–10 show sequential steps in a preferred method for forming the seam structure which is shown in FIG. 7. As can be seen, the rows of upper and lower tab portions 180*a*, 180*b* and 182, 182*b* are initially cut and bent upwardly and downwardly along the edges of the two flange portions 142, 144, using cutter wheels or other suitable means. The side walls and the web portions are then bent towards one another so as to shape the tubing into its desired, generally rectangular configuration, and the tubing is then passed through horizontally opposed rollers 194, 196 which bear against the side walls 124, 126 of the tubing so as to force the tab portions into an initial, intermitting engagement as shown in FIG. 9.

In the next roll-forming stage, the tubing is passed between a set of vertically opposed rollers 200, 202. A stationary die 204 is interposed between the rollers, in engagement with the inside surfaces of the upper and lower walls of the tubing, so as to transfer the compressive loads therethrough (the die is mounted on a rod which extends between the rollers "upstream" of those which are shown in FIGS. 9–10).

As can be seen in FIG. 10, the upper surface 206 of the die is formed with a recessed channel 208 in the area below the seam structure 150. The depth of the channel is selected to correspond approximately of that of the overlapped upper and lower tab portions (i.e., approximately double the thickness of the aluminum alloy sheet material which the tubing is formed). Thus, as the tubing passes between the upper and lower rollers, the upper roller bends and presses the upper tab portions 180*a*, 182*b* downwardly into a flat, generally horizontal orientation, while the channel 208 in the die bends the lower tab portions 180*b*, 182*b* upwardly into a generally horizontal orientation against the bottom surfaces of the upper tab portions. The depth of the channel 208 is selected to be sufficiently shallow to force the surfaces of the upper and lower tab portions into the desired, face-to-face, sliding engagement, but is deep enough to prevent the metal from becoming fused where the upper and lower tab portions meet; as was noted above, the depth of the groove may suitably be about twice that of the thickness of the alloy sheet material.

Thus, when the tubing passes out of the rollers in its finished form, the resilience of the aluminum alloy material causes the upper and lower tab portions to spring apart slightly, so as to create a small gap 210 which provides a degree of clearance between the parallel bearing surfaces 212, 214 on the overlapped tab portions. The clearance is relatively small (e.g., 0.001–0.003"), however it is sufficient to permit the tabs to slide laterally with respect to one another with a minimum of resistance, while still maintaining the desired degree of strength and structural integrity in seam 150. It should be noted that this construction is distinct from other forms of overlapping structures where no clearance is provided for allowing movement between the two components.

The finished product having the preferred configuration shown in the drawings thus has a smooth, aesthetically pleasing external appearance, and is free from rough or sharp edges along the exposed side of the seam structure 150. It will be understood, however, that in some embodiments the seam may be formed with tab portions having different orientations and/or shapes from those which have been shown herein.

d. Example Dimensions

The dimensions of the spacer tubing in accordance with the present invention will vary depending on the size of the window assembly, the material from which the tubing is formed, and other design factors. In one exemplary embodiment, satisfactory dimensions have been found to be as follows:

| Material | Roll-formed aluminum alloy sheet |
|---|---|
| Material thickness | 1/64" |
| Inner wall width | 1/2" |
| Overall seam width | 1/16" |
| Tab end portion length | 3/64" |
| Tab portion end gap | 1/64" |
| Outer wall width | 3/8" |

When using 1/64" roll-formed aluminum alloy material, the width of the tab portions is preferably within the range from 3/32" to about 1/32" for those embodiments in which the tubing is intended to be bent to form the corners of the frame assembly, with the latter width being most preferred; widths above this range tend to result in the seam separating upon bending, while tabs having narrower widths tend to lack sufficient strength and structural integrity. However, for those embodiments where the tubing is not intended to be bent to form the corners of the spacer frames (e.g., the corners are formed by molded plastic connectors or the like), the range of acceptable widths for the tab portions may be much greater; for example, tab portions having a width of 3/8" or greater may be suitable for use in many such embodiments. Again, the actual dimensions in a particular embodiment may vary from those given above, depending on materials and applicable design factors.

It is to be recognized that various alterations, modifications, and/or additions may be introduced into the constructions and arrangements of parts described above without departing from the spirit or ambit of the present invention as defined by the appended claims.

What is claimed is:

1. An insulated window assembly, comprising:

first and second glass panes; and spacer frame tubing mounted between said first and second glass panes, said spacer frame tubing comprising:

first and second sidewall portions for engaging inner surfaces of said glass panes; and a transverse wall portion interconnecting said sidewall portions so as to support said sidewall portions in spaced-apart relationship, said transverse wall portion being configured to permit said sidewall portions to move alternately towards and away from one another in response to inwardly and outwardly directed forces exerted by said glass panes so as to minimize development of a pivoting action between said inner surfaces of said panes and said sidewall portions of said spacer frame tubing.

2. Spacer frame tubing for being mounted between first and second glass panes in an insulated window assembly, said tubing comprising:

first and second sidewall portions for engaging inner surfaces of said glass panes; and a transverse wall portion interconnecting said sidewall portions so as to support said sidewall portions in spaced-apart relationship, said transverse wall portion being configured to permit said sidewall portions to move alternately towards and away from one another in response to inwardly and outwardly directed forces exerted by said glass panes so as to minimize development or a pivoting action between said inner surfaces of said panes and said sidewall portions of said spacer frame tubing, said transverse wall portion of said tubing comprising at least first and second web portions which extend from said sidewall portions and which are joint by a seam structure, said seam structure being configured to permit said web portions to move alternately towards and away from one another in response to said inwardly and outwardly directed forces exerted by said glass panes in said assembly.

3. The spacer frame tubing or claim 2, wherein said seam structure comprises:

a plurality of tab portions formed on edges of said first and second web portions, said tab portions on said first web portion forming a sliding interfit with said tab portions on said second web portion so as to permit said web portions to move alternately towards and away from one another.

4. The spacer frame tubing of claim 3, wherein said tab portions on said edge of said first web portion alternately overlap and underlap said tab portions on said edge of said second web portion in sliding interfit therewith.

5. The spacer frame tubing of claim 4, wherein said overlapping and underlapping tab portions meet along planar engagement surfaces which extend generally parallel to said first and second web portions.

6. The spacer frame tubing of claim 5, wherein said first and second web portions extend in generally co-planar relationship.

7. The spacer frame tubing of claim 6, wherein said tab portions on each said edge of said web portions comprise alternating upper and lower tab portions, said upper tab portions extending in generally co-planar relationship with said web portion and said lower tab portions bending downwardly from base portions at which said lower tab portions are joined to said web portions.

8. The spacer frame tubing or claim 7, wherein each of said tab portions comprises a substantially rectangular outer end.

9. The spacer frame tubing of claim 8, wherein said base portions of said lower tab portions are positioned a spaced distance from said juxtapositioned outer ends of said upper top portions so as to form a gap for permitting said ends of said upper tab portions to move towards said bases of said lower tub portions as said first and second web portions move towards one another.

10. The spacer frame tubing of claim 8, wherein said rectangular outer ends of said upper and lower tab portions each comprise:

first and second edge races for engaging, corresponding edge faces on outer ends of adjoining tab portions in sliding interfit therewith.

11. The spacer frame tubing of claim 2, further comprising:

a second transverse wall portion, so that said sidewall portions and said transverse wall portions cooperate to define a hollow interior of said tubing.

12. The spacer frame tubing of claim 11, further comprising:

a particulate desiccant material disposed within said hollow interior of said tubing.

13. The spacer frame tubing of claim 11, wherein said tubing has a generally rectangular cross-section.

14. The spacer frame tubing of claim 13, further comprising:

at least one projecting rib formed on each said sidewall portion of said tubing for limiting engagement with said inner surfaces of said glass panes to line-contact engagement therewith.

15. The spacer frame tubing of claim 14, wherein said projecting ribs on said sidewall portions are formed proximate said transverse wall portion having said seam structure formed therein.

16. The spacer frame tubing of claim 2, wherein said tubing is constructed of roll-formed sheet aluminum alloy material.

17. The spacer frame tubing of claim 6, wherein said tubing is constructed of roll-formed sheet aluminum alloy material.

18. An insulated window assembly comprising:

first and second glass panes having inner surfaces; and spacer frame tubing mounted between said first and second glass panes, said tubing comprising:

first and second sidewall portions mounted in engagement with inner surfaces of said glass panes; and a transverse wall portion interconnecting said sidewall portions so as to support said sidewall portions in spaced-apart relationship, said transverse wall portion being configured to permit said sidewall portions to move alternately towards and away from one another in response to inwardly and outwardly directed forces exerted by said glass panes so as to minimize development of a pivoting action between said inner surfaces of said panes and said sidewall portions of said spacer frame tubing.

19. The insulated window assembly of claim 18, wherein said transverse wall portion of said spacer fame tubing comprises:

at least first and second wed portions which extend from said sidewall portions and which are joined by a seam structure, said seam structure being configured to permit said web portions to move alternately towards and away from one another in response to said inwardly and outwardly directed forces exerted by said glass panes in said assembly.

20. The insulated window assembly of claim 19, wherein said seam structure comprises:

a plurality of tab portions formed on edges of said first and second web portion, said tab portions on said first web portion forming a sliding interfit with said tab portions on said second web portion so as to permit said web portions to move alternately towards and away from one another.

21. The insulated window of claim 20, wherein said lab portions on said edge of said first web portion alternately overlap and underlap said tab portions on said edge of said second web portion in sliding interfit therewith.

22. The insulated window assembly of claim 21, wherein said overlapping and underlapping tab portions meet along planar engagement surfaces which extend generally parallel to said first and second web portions.

23. The insulated window assembly of claim 22, wherein said first and second web portions extend in generally co-planar relationship.

24. The insulated window assembly of claim 23, wherein said tab portions on each said edge of said web portions comprise alternating upper and lower tab portions, said upper tab portions extending in generally co-planar relationship with said web portion and said lower tab portions bending downwardly from base portions at which said lower tab portions are joined to said web portions.

25. The insulated window assembly of claim 24, wherein each of said tab portions comprise a substantially rectangular outer end.

26. The insulated window assembly of claim 25, wherein said base portions of said lower tab portions are positioned a spaced distance from juxtapositioned outer ends of said upper tab portions so as to form) a gap for permitting said ends of said upper tab portions to move towards said bases of said lower tab portions as said first and second web portions move towards one another.

27. The insulated window assembly of claim 26, wherein said rectangular outer ends of said upper and lower tab portions each comprise:

first and second edge faces for engaging corresponding edge races on outer ends of adjoining tab portions in sliding interfit therewith.

28. The insulated window assembly of claim 19, wherein said tubing has a generally rectangular cross-section.

29. The insulated window assembly of claim 28, further comprising:

at least one projecting rib formed on each said sidewall portion of said tubing for limiting engagement with said inner surfaces of said glass panes to line-contact engagement therewith.

30. The insulated window assembly of claim 29, wherein said projecting rib on said sidewall portions are formed proximate said transverse wall portion having said seam structure formed therein.

31. The insulated window assembly of claim 18, wherein said tubing is constructed of roll-formed sheet aluminum alloy material.

32. The insulated window assembly of claim 18, wherein said spacer frame tubing is mounted between outer edges of said glass panes proximate a perimeter of said assembly, said inward forces exerted against said sidewall portions of said tubing are being caused by inward bowing of said glass panes in response to an in increase in atmospheric pressure, and said outward forces exerted against said sidewall portions of said tubing being caused by outward bowing of said glass panes in response to a decrease in atmospheric pressure.

33. The insulated window assembly of claim 32, further comprising: a sealing strip mounted between said outer edges of said glass panes outside of said spacer frame tubing.

34. The spacer frame tubing of claim 4, wherein said overlapping tab portions are spaced apart so as to form an open gap that permits said tab portions on said first and second web portions to slide laterally relative to one another.

35. The insulated window of claim 21, wherein said overlapping tab portions are spaced apart so as to form an open gap that permits said tab portions on said first and second web portions to slide laterally relative to one another.

* * * * *